US008976502B2

(12) United States Patent
Usai et al.

(10) Patent No.: US 8,976,502 B2
(45) Date of Patent: Mar. 10, 2015

(54) ELECTROMAGNETICALLY ACTUATED SWITCHING DEVICE AND A METHOD FOR CONTROLLING THE SWITCHING OPERATIONS OF SAID SWITCHING DEVICE

(75) Inventors: Roberto Usai, Treviolo (IT); Manuel Gotti, Bergamo (IT)

(73) Assignee: ABB Technology AG, Zurich (CH)

( * ) Notice: Subject to any disclaimer, the term of this patent is extended or adjusted under 35 U.S.C. 154(b) by 226 days.

(21) Appl. No.: 13/461,267

(22) Filed: May 1, 2012

(65) Prior Publication Data

US 2012/0281331 A1 Nov. 8, 2012

(30) Foreign Application Priority Data

May 2, 2011 (EP) ..... 11164404

(51) Int. Cl.
*H01H 47/00* (2006.01)
*H01H 47/32* (2006.01)

(52) U.S. Cl.
CPC ..... *H01H 47/325* (2013.01)
USPC ..... 361/160

(58) Field of Classification Search
USPC ..... 361/160
See application file for complete search history.

(56) References Cited

U.S. PATENT DOCUMENTS

| | | | | |
|---|---|---|---|---|
| 2,751,467 | A * | 6/1956 | Alexy | 218/147 |
| 6,518,764 | B2 * | 2/2003 | Shirato | 324/413 |
| 7,405,917 | B2 * | 7/2008 | Ahrens et al. | 361/152 |

FOREIGN PATENT DOCUMENTS

| | | | |
|---|---|---|---|
| EP | 0279592 | A2 | 8/1988 |
| EP | 0376493 | A1 | 7/1990 |
| EP | 1923986 | A2 | 5/2008 |
| EP | 1998351 | A1 | 12/2008 |

OTHER PUBLICATIONS

European Search Report issued Oct. 28, 2011 in EP Application No. 11164404.

* cited by examiner

*Primary Examiner* — Rexford Barnie
*Assistant Examiner* — Tien Mai
(74) *Attorney, Agent, or Firm* — Novak Druce Connolly Bove + Quigg LLP

(57) ABSTRACT

A switching device comprising control means for controlling the switching operations of the device, the control means receiving the sensing signals generated by a sensor means; the control means are arranged so that, during execution of a switching operation, the control means send a first control signal to a power supply means to start with the supply of excitation current from a first instant onwards; determine, on the base of the information provided by the sensing signals, a second instant, at which the power supply means have to stop with the supply of excitation current, the second instant occurring before the movable plunger has reached the stop position during the movement from the start position towards the stop position; send a second control signal to the power supply means to stop with supply of excitation current from the second instant and until a movable plunger reaches the stop position.

20 Claims, 3 Drawing Sheets

Figure 1:
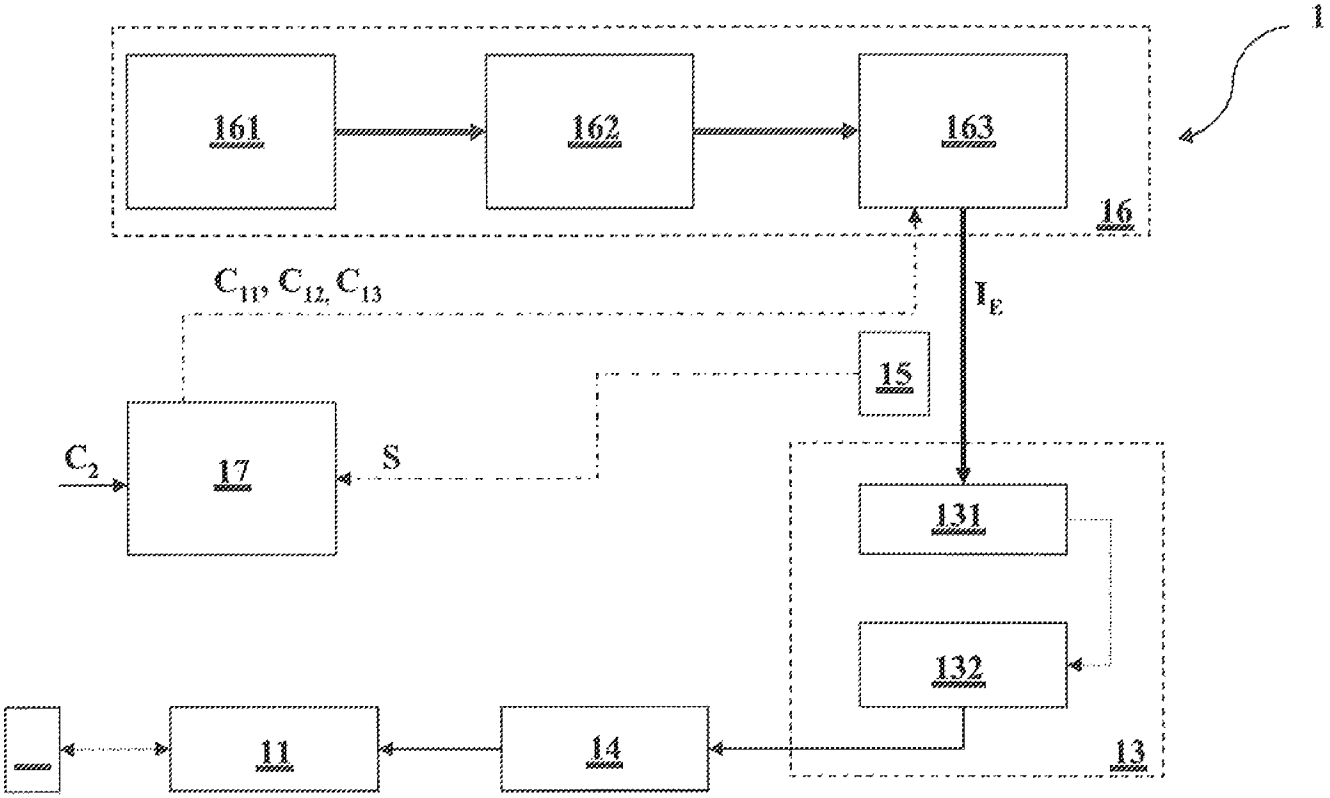

ELECTROMAGNETICALLY ACTUATED SWITCHING DEVICE AND A METHOD FOR CONTROLLING THE SWITCHING OPERATIONS OF SAID SWITCHING DEVICE

CROSS REFERENCE TO RELATED APPLICATIONS

This application is claims priority to Application No. 11164404.3 filed in Europe on May 2, 2012 under 35 U.S.C. §119; the entire contents of which is hereby incorporated by reference.

The present invention relates to an electromagnetically actuated switching device for low or medium voltage applications, such as a circuit breaker, a contactor, a disconnector, a recloser or the like.

In a further aspect, the present invention relates to a method for controlling the switching operations (i.e. the closing or opening operations of the electric contacts) of said switching device.

For the purposes of the present invention, the terms low voltage (LV) or medium voltage (MV) identify voltages having values respectively lower than 1 kV and from 1 kV up to some tens of kV, e.g. 50 kV.

As it is known, a LV or MV switching device normally comprises a control unit and an actuation chain for coupling or uncoupling the electric contacts during a switching operation of the switching device.

Most traditional switching devices are generally of mechanical type, i.e. provided with an actuation chain that adopts mechanical arrangements to actuate the mobile contact of the switching device.

More recently, electromagnetically actuated switching devices have been introduced in the market.

These devices comprise an electromagnetic actuator for actuating the mobile contact, which generally comprises a magnetic circuit provided with an excitation coil operatively associated to a movable plunger that is mechanically coupled to the mobile contact.

Power supply means are also arranged for drawing electric power from a power distribution line in order to supply an excitation current to the excitation coil.

Typically, once a switching command (i.e. closing or opening command) is received, the control unit sends control signals to the power supply means to command them to supply the excitation current for a predetermined time.

The magnetic field generated by the excitation current circulating in the excitation coil operates the movable plunger that can be reversibly moved between two operative positions, each corresponding to a coupling or an uncoupling position of the electric contacts.

It is widely admitted that switching devices of the electromagnetic type have represented a remarkable improvement in the state of the art.

However, they still have some drawbacks.

The practice has shown that during a switching operation the movable plunger stores up a relatively high kinetic energy that is transmitted to the remaining portions of the actuation chain when the movable plunger stops its run.

Often, this causes overrun or bouncing phenomena of the electric contacts with a consequent reduction of the safety and reliability of the switching operations.

Further, the actuation chain is subject to relevant mechanical stresses and vibrations that often lead to the rapid arising of wear phenomena.

Frequent maintenance interventions are thus needed to ensure a satisfactory level of efficiency and reliability of the switching device.

Unfortunately, such interventions are quite time consuming and expensive. Operative costs of the switching device thus remarkably increase.

The above mentioned drawbacks become even more dramatic when many (around 1000000) switching operations are executed during the operative life of the switching device, as it happens when the switching device works as an electric contactor.

It is therefore an aim of the present invention to provide a switching device of the electromagnetic type (i.e. adopting an electromagnetic actuator for actuating the electric contacts), which allows to overcoming the drawbacks explained above.

Within this aim, another object of the present invention is to provide a switching device, in which relatively low mechanical stresses and vibrations are transmitted to the members of the actuation chain during switching, operations.

Another object of the present invention is to provide a switching device that ensures a high level of safety and reliability.

Not the least object of the present invention is to provide a switching device that can be easily realized at competitive costs and is characterised by relatively low operative costs.

Thus, the present invention provides a switching device according to the following claim 1.

According to a general definition, the switching device according to the invention comprises at least a movable contact and a fixed contact that are adapted to be coupled or uncoupled during a switching operation of the switching device.

The switching device, according to the invention, comprises also an electromagnetic actuator that comprises an excitation coil, in which an excitation current circulates during a switching operation, and a movable plunger, which is operatively coupled to the movable contact through a kinematic chain.

The movable plunger is operated between a start position and a stop position during a switching operation.

The switching device, according to the invention, further comprises power supply means for supplying the excitation current to the excitation coil during a switching operation and sensor means for generating sensing signals indicative of the intensity of the excitation current circulating in the excitation coil.

The switching device, according to the invention, is also provided with control means for controlling the switching operations of the switching device, which receive the sensing signals generated by the sensor means.

Said control means are arranged so that, during a switching operation of the switching device, they:

send a first control signal to the power supply means to command said power supply means to start with the supply of the excitation current from a first instant onwards;

determine, on the base of information provided by the sensing signals sent by said sensor means, a second instant, at which the power supply means have to stop with the supply of the excitation current, said second instant occurring before the movable plunger has reached the stop position during the movement from said start position towards said stop position;

send a second control signal to the power supply means to command said power supply means to stop with the supply of the excitation current from said second instant and until the movable plunger reaches said stop position.

A further aspect of the present invention relates to a method for controlling a switching operation of a switching device, according to the following claim 6.

In general definition, the method according to the invention comprises the following steps:

sending a first control signal to the power supply means to command said power supply means to start with the supply of the excitation current from a first instant onwards;

determining, on the base of the sensing signals provided by the sensor means, a second instant, at which the power supply means have to stop with the supply of the excitation current, said second instant occurring before the movable plunger has reached the stop position during the movement from the start position towards said stop position;

sending a second control signal to the power supply means to command said power supply means to stop with the supply of the excitation current from said second instant and until the movable plunger reaches said stop position.

Preferably, the second instant, at which the power supply means have to stop with the supply of the excitation current, is an instant at which the movable plunger of the electromagnetic actuator has already reached a no return position during the movement from the start position towards the stop position.

Preferably, said second instant is an instant at which the following operating conditions are achieved:

the excitation current decreases after having reached a peak value at a peak instant;

a predefined period of time has passed from said peak instant;

the excitation current is lower than a threshold value, said threshold value being calculated on the base of said peak value.

Figure 2:
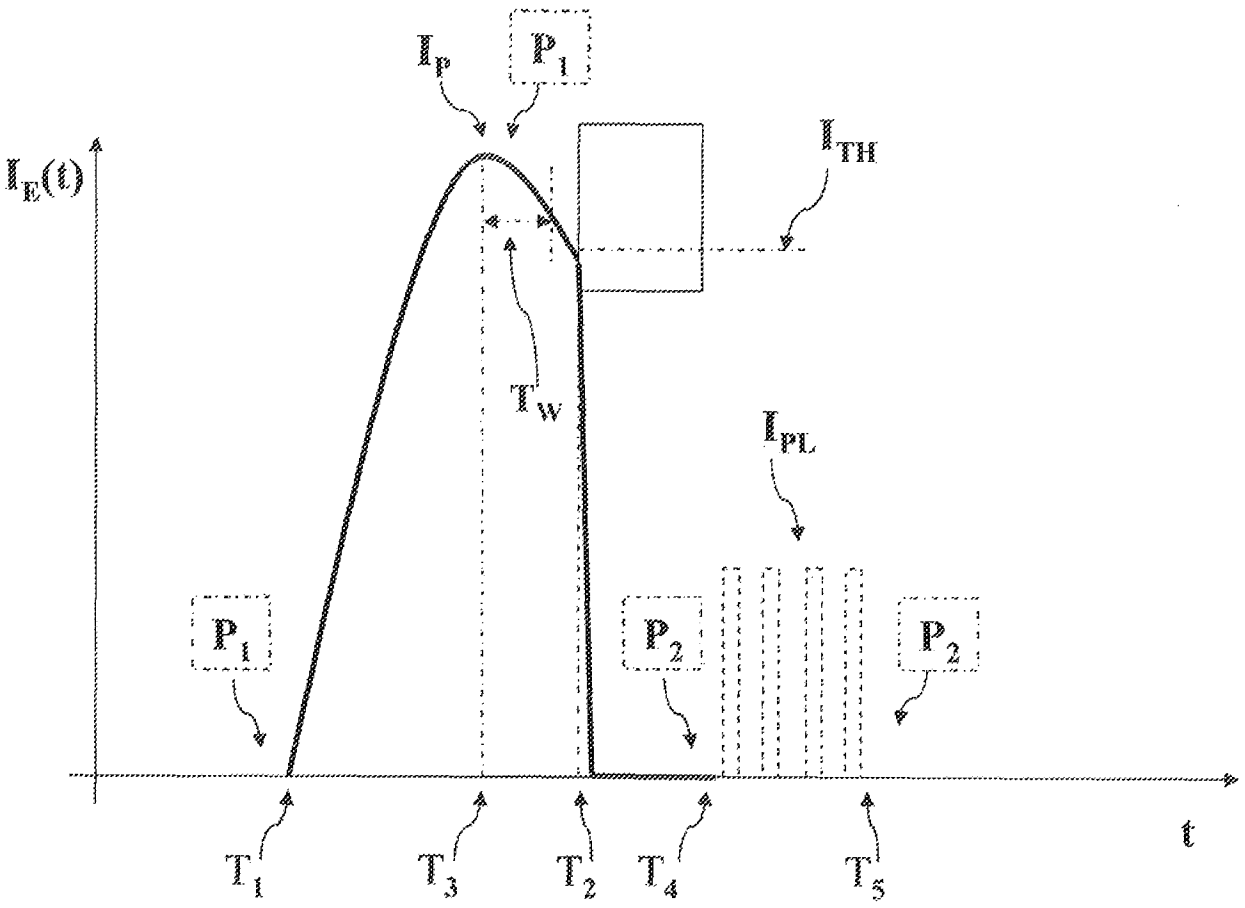
Figure 3:
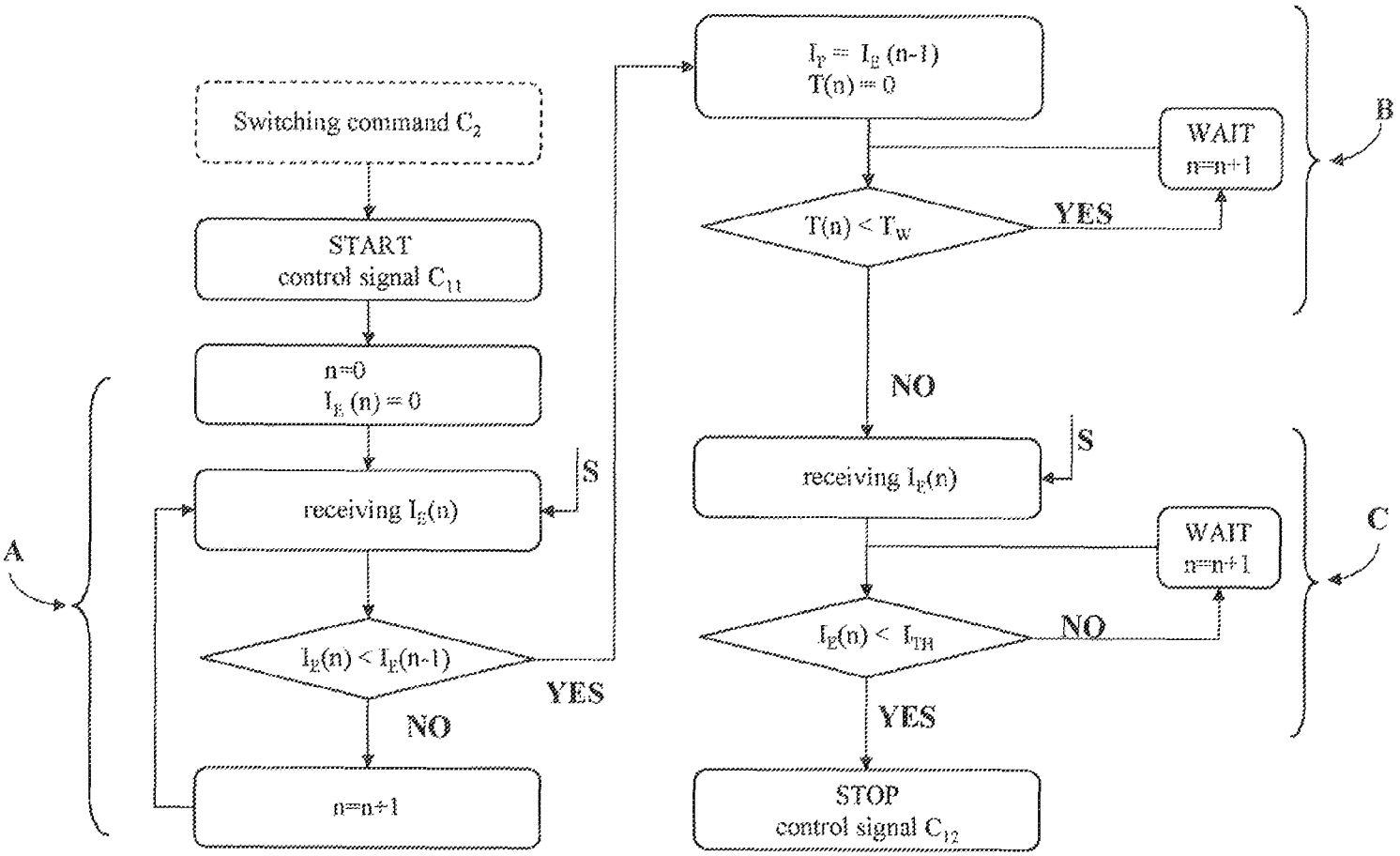

Further characteristics and advantages of the switching device, according to the present invention, will become more apparent from the detailed description of preferred embodiments illustrated only by way of non-limitative example in the accompanying drawings, in which:

FIG. 1 is a block diagram that schematically illustrates a preferred embodiment of the switching device according to the present invention; and FIGS. 2-3 are diagrams that schematically illustrate the operation of the switching device according to the present invention.

Referring to the cited figures, the switching device, according to the present invention, indicated by the reference 1, comprises at least a movable contact 11 and a fixed contact 12, which are electrically connected to a phase conductor of a power distribution line (not shown).

The movable contact 11 and the fixed contact 12 are suitable to be coupled or uncoupled respectively during a switching operation of the switching device 1.

A switching operation may be a closing operation, in which the contacts 11 and 12 are brought from an uncoupled state to a coupled state, or an opening operation, in which the contacts 11 and 12 are brought from a coupled state to an uncoupled state.

The switching device 1 comprises an electromagnetic actuator 13 that comprises an excitation coil 131 and a movable plunger 132 that is operatively coupled to the movable contact 11 through a kinematic chain 14.

During a switching operation of the switching device, an excitation current $I_E$ circulates in the excitation coil 131 in order to generate a magnetic flux. The movable plunger 132 is operated by a magnetic force generated by said magnetic flux, in particular by the portion of said magnetic flux that is enchained with the movable plunger 132.

During a switching operation of the switching device, the movable plunger 132 is operated between a start position $P_1$ and a stop position $P_2$.

If a closing operation is performed, the start position $P_1$ and the stop position $P_2$ are the positions of the movable plunger 132, at which the mobile contact 11 is respectively in a coupled and uncoupled state with the fixed contact 12.

Viceversa, if an opening operation is performed, the start position $P_1$ and the stop position $P_2$ are the positions of the movable plunger 132, at which the mobile contact 11 is respectively in uncoupled and coupled state with the fixed contact 12.

Preferably, the electromagnetic actuator 13 comprises a magnetic circuit (not shown), on which the excitation coil 131 is wounded in order to properly address the streamlines of the magnetic flux generated by the excitation current $I_E$.

One or more permanent magnets (not shown) may be arranged along said magnetic circuit in order to generate a permanent magnetic force that is always directed at steadily maintaining the movable plunger 132 in the stop position $P_2$ when the run of the plunger is concluded.

The switching device 1 further comprises power supply means 16 that supply the excitation current $I_E$ to the excitation coil 131 during a switching operation.

Preferably, the power supply means 16 comprise a power storage stage 162, a first power supply stage 161 for charging the storage stage 162 and a second power supply stage 163 to feed the excitation coil 131 with the excitation current $I_E$.

The power storage stage 162 is able to store a certain amount of electric energy and it preferably comprises one or more capacitor banks.

The first power supply stage 161 may advantageously comprise some power circuits that are arranged to drain electric power from a power distribution line (not shown) and charge the storage stage 162.

The second power supply stage 163 is advantageously connected downstream the power storage stage 162 and it may comprise suitable power circuits that are capable of regulating the power supply (i.e. the supply of excitation current $I_E$) from the power storage stage 123 to the excitation coil 131.

The switching device 1 comprises also sensor means 15 that generate sensing signals S that are indicative of the intensity of the excitation current $I_E$ circulating in the excitation coil 131, and control means 17 for controlling a switching operation of the switching device 1.

Preferably, the sensing signals S are discrete-time signals that comprise series of sampling values indicative of the intensity of the excitation current $I_E$ that is sampled by the sensor means 15 at subsequent sampling instants.

In particular, the control means 17 are advantageously capable of generating control signals $C_{11}$ and $C_{12}$ to command the power supply means 16, in particular the second power supply stage 163, on how to regulate the supply of the excitation current $I_E$ to the excitation coil 131. Further, the control means 17 are advantageously arranged to receive the sensing signals S from the sensor means 15 and switching commands $C_2$ (i.e. closing or opening commands) from a protection device (not shown) or a man machine interface (not shown) that is operated by a user.

Preferably, the control means 17 comprises a computerized unit, such as a microprocessor. According to the invention, the control means 17 are arranged so that they execute certain actions for improving the regulation of the switching operations of the switching device. Such arrangements preferably comprise proper software programs executable by the mentioned computerized unit.

According to the invention, when a switching operation (i.e. a closing or an opening operation) has to be executed, the control means 17 send a first control signal $C_{11}$ to the power supply means 16 in order to command these latter to start with the supply of the excitation current $I_E$ from a first instant $T_1$ onwards.

Advantageously, the first control signal $C_{11}$ may be generated by the control means 17 when a switching command $C_2$ is received.

On the base of the information provided by the sensing signals S, the control means 17 calculate a second instant $T_2$, at which the power supply means 16 have to stop with the supply of the excitation current $I_E$ to the excitation coil 131.

As soon as that the second instant $T_2$ is determined, the control means 17 send a second control signal $C_{12}$ to the power supply means 16 to stop with the supply of the excitation current $I_E$ to the excitation coil 131 from said second instant $T_2$ and until the movable plunger reaches the stop position $P_2$ within an instant $T_4$.

Referring now to FIG. 2, the operation of the control means 17 will now be described in more detail.

As soon as the first control signal $C_{11}$ is received from the control means 17, the power supply means 16 supply the excitation current $I_E$ to the excitation coil 131, starting from the first instant $T_1$.

In this phase the excitation current $I_E$ rapidly increases to energize the excitation coil 131. When the excitation current $I_E$ reaches a peak value $I_P$ at a peak instant $T_3$, it means that the movable plunger 132 has started its movement towards the stop position $P_2$, since a sufficient energization of the excitation coil has been achieved to generate a magnetic force that is strong enough to operate the movable plunger 132.

From the instant $T_3$ onwards the movable plunger is subject to a constant acceleration imposed by the magnetic force generated by the excitation coil 131 and therefore its velocity increases while the excitation current $I_E$ will in turn decrease.

It should be noticed that the: timing of the peak instant $T_3$ varies according to the actual operative conditions of the actuation chain formed by the movable plunger 132 and the kinematic chain 14.

For example, the instant $T_3$ may vary during the operating life of the switching device due to the arising of friction or wear phenomena, temperature variations or the addition of external loads.

According to the invention, the second instant $T_2$, which is calculated by the control means 17 for stopping the supply of the excitation current $I_E$, occurs before the movable plunger 132 has reached the stop position $P_2$ (instant $T_4$) during its movement from the start position $P_1$ towards the stop position $P_2$.

The second instant $T_2$ is thus comprised between the instant $T_3$, at which the movable plunger 132 starts moving from the start position $P_1$, and the instant $T_4$, at which the movable plunger 132 reaches the stop position $P_2$.

Preferably, the second instant $T_2$ is an instant at which the movable plunger 132 has already reached a no-return position during its movement from the start position $P_1$ towards the stop position $P_2$.

Said no-return position is the position at which the movable plunger 132 achieves sufficient kinetic energy to continue its run and reach the stop position $P_2$ without the need of the magnetic force generated by the excitation coil 131.

In other words, said no-return position is the position after which the movable plunger 132 can reach the stop position $P_2$ only thanks to its own inertial force and, possibly, thanks to the magnetic force generated by the permanent magnets arranged in the electromagnetic actuator. Preferably, the second, instant $T_2$ is run-time calculated on the base of the peak value $I_P$ that is reached by the excitation current $I_E$ during the switching operation.

This solution is quite advantageous. Since the instant $T_3$ depends on actual operative conditions of the actuation chain of the switching device 1 the calculation of the instant $T_2$ is intrinsically compensated with respect to possible variations of the operative status of the actuation chain of the switching device.

Advantageously, the instant $T_2$ is calculated by the control means 17 as an instant at which the following operating conditions are achieved:

the excitation current $I_E$ decreases after having reached the peak value $I_P$ at the peak instant $T_3$;

a predefined period of time $T_W$ has passed from the peak instant $T_3$;

the excitation current $I_E$ is lower than a threshold value $I_{TH}$.

Preferably, the predefined period of time $T_W$ is fixed on the base of the nominal performances that are foreseen for the actuation chain of the switching device. The time interval between the instants $T_3$ and $T_4$ (i.e. the time employed by the movable plunger 132 to move between the positions $P_1$ and $P_2$) depends on the distance between P1 and P2 and on the speed of the movable plunger 132 and is generally comprised between 3.5 ms and 3.7 ms. A value for the period of time $T_W$ may be reasonably set at 2 ms for most of the switching devices to be offered in the market.

The threshold value $I_{TH}$ is advantageously calculated on the base of the peak value $I_P$, preferably according to the following relation $I_{TH}=K*I_P$ with $0.7<K<0.9$. Preferably the threshold value $I_{TH}$ is set as $I_{TH}=0.8*I_P$.

As soon as the first control signal $C_{12}$ is received, the power supply means 16 stop supplying the excitation current. $I_E$ to the excitation coil 131, starting from the second instant $I_2$. From the instant $T_2$ onwards, the velocity of the movable plunger 132 remains constant until the movable plunger 132 reaches the stop position $P_2$. In fact, the movable plunger 132 is no more accelerated by the magnetic force generated by the excitation current $I_E$ but it moves only thanks to its inertial force and, possibly, thanks to the magnetic force generated by the permanent magnets.

The movable plunger 132 thus reaches the stop position $P_2$ with a kinematic energy that is quite lower than in traditional solutions.

This allows to remarkably reducing the mechanical stresses and vibrations transmitted to the members of the actuation chain during the switching operations.

According to a preferred embodiment of the present invention, the control means 17 are arranged to execute a plurality of control routines in order to determine the second instant $T_2$. Each control routine is, advantageously implemented by simple software programs executable by the mentioned computerized unit.

After having sent the control signal $C_{11}$, the control means 17 preferably execute a first control routine A to check whether the excitation current $I_E$ has reached the peak value $I_P$.

As it is apparent from FIG. 3, the control routine A comprises a comparison loop, in which the value $I_E(n)$ of the excitation current at the $n^{th}$ instant is compared with the value $I_E(n-1)$ of the excitation current at the $n-1^{th}$ instant.

The values indicative of the excitation current $I_E$ at subsequent sampling instants ( . . . n−1, n, n+1, . . . ) are provided by the sensing signals S.

Once the control condition $I_E(n)<I_E(n-1)$ is achieved the comparison loop is interrupted and the value $I_E(n-1)$ is considered as the peak value $I_P$ of the excitation current $I_E$.

The control means 17 then start a second control routine. B to check whether the predefined period of time $T_W$ has passed from the peak instant $T_P$.

Also the control routine B advantageously comprises a comparison loop, in which an increasing time value T(n) is, compared with the predefined time value $T_W$. Once the control condition $T(n)>T_W$ is obtained, the comparison loop is interrupted.

The control means 17 then execute a third control routine C to check whether the excitation current $I_E$ is lower than the threshold value $I_{TH}$.

The control routine C advantageously comprises a further comparison loop, in which the value $I_E(n)$ of the excitation current at the $n^{th}$ instant is compared with the threshold value $I_{TH}$. Also in this case, the values indicative of the excitation current $I_E$ at subsequent sampling instants ( . . . n−1, n, n+1, . . . ) are provided by the sensing signals S.

Once the control condition $I_E(n)<I_{TH}$ is obtained, the comparison loop is interrupted and the $n_{th}$ instant, at which the above control condition is achieved, is considered as the instant $T_2$ at which the supply of the excitation current to the excitation coil 131 has to be interrupted.

According to a further embodiment of the present invention, the control means 17 are arranged to send third control signals $C_{13}$ to the power supply means 16 to command the m to supply one or more pulses $I_{PL}$ of the excitation current $I_E$ to the excitation coil 131, after the movable plunger 132 has reached the stop position $P_2$ at the instant $I_4$.

This solution is quite advantageous to steadily maintaining the movable plunger 132 at its stop position $P_2$ until the on-going switching operation ends at the instant $T_5$.

A further aspect of the present invention relates to a method for controlling the switching operations of the switching device 1.

In accordance with the aspects of the present invention illustrated above, the method, according to the invention, applies advantageously to a closing or an opening operation of the switching operation of the switching device.

The method, according to the invention comprises the following steps:

sending the first control signal $C_{11}$ to the power supply means 16 to command them to start with the supply of the excitation current from the first instant $T_1$ onwards;

determining, on the base of the information provided by the sensing signals S, the second instant $T_2$, at which the power supply means 16 have to stop with the supply of the excitation current $I_E$. The second instant $T_2$ occurs before the movable plunger 132 has reached the stop position $P_2$;

sending a second control signal $C_{12}$ to the power supply means 16 to command them to stop with the supply of the excitation current $I_E$ from the second instant $T_2$ and until the movable plunger 132 reaches the stop position $P_2$.

Preferably, the step of determining the second instant $T_2$ comprises the sub-steps of:

checking whether the excitation current $I_E$ has reached the peak value $I_P$;

checking whether the predefined period of time $T_W$ has passed from the peak instant $I_P$;

checking whether the excitation current $I_E$ is lower than the threshold value $I_{TH}$, said threshold value being calculated on the base of the peak value $I_P$.

Further, the method, according to the invention, preferably comprises the step of sending the third control signals $C_{13}$ to the power supply means 16 to supply one or more pulses $I_{PL}$ of the excitation current $I_E$, after the movable plunger 132 has reached the stop position $P_2$.

The switching device 1, according to the present invention, allows achieving the intended aims and objects.

In the switching device, according to the invention, low mechanical stresses and vibrations are transmitted to remaining mechanical parts of the actuation chain of the electromagnetic actuator during the movement of the movable plunger.

With respect to traditional solutions, this fact leads to a reduction of wear phenomena. The number of maintenance interventions that are needed during the operating life of the switching device can thus be advantageously decreased.

In the switching device, according to the invention, the probability of overrun or bouncing phenomena between the electric contacts is reduced with respect to traditional solutions. Laboratory tests have proven how this fact provides remarkable advantages when switching operations of the switching device are performed on capacitive loads.

Further, dielectric distances among the energized portions of the switching device may be reduced, which allows to obtain a more compact structure for the switching device with considerable advantages during the realization and installation of the switching device.

The switching device, according to the invention, has relatively low manufacturing costs and has proven to be characterised by a high level of safety and reliability in switching operations.

The invention claimed is:

1. A switching device comprising:

at least a movable contact and a fixed contact that are adapted to be coupled or uncoupled during a switching operation of said switching device;

an electromagnetic actuator comprising an excitation coil, in which an excitation current circulates during a switching operation, and a movable plunger, which is operatively coupled to said movable contact through a kinematic chain, said movable plunger being operated between a start position and a stop position during a switching operation;

power supply means that supply said excitation current to said excitation coil during a switching operation;

sensor means that generate sensing signals indicative of the intensity of said excitation current;

control means for controlling the switching operations of said switching device, said control means receiving the sensing signals generated by said sensor means;

wherein said control means are arranged so that, during the execution of a switching operation, said control means:

send a first control signal to said power supply means to start with the supply of said excitation current from a first instant onwards;

determine, on the base of the information provided by said sensing signals, a second instant, at which said power supply means will stop the supply of said excitation current, said second instant occurring before said movable plunger has reached said stop position during the movement from said start position towards said stop position;

send a second control signal to said power supply means to stop with the supply of said excitation current from said second instant and until said movable plunger reaches said stop position;

wherein said plunger is configured to commence movement from the start position toward the stop position when said excitation current reaches a peak value.

2. A switching device, according to claim 1, wherein said second instant is an instant at which said movable plunger has already reached a no return position during the movement from said start position towards said stop position.

3. A switching device, according to claim 2, wherein said second instant is an instant at which the following operating conditions are achieved:

the excitation current decreases after having reached a peak value at a peak instant;

a predefined period of time has passed from said peak instant;

said excitation current is lower than a threshold value ($I_{TH}$), said threshold value being calculated on the base of said peak value.

4. A switching device, according to claim 2, wherein said control means are arranged so that, in order to determine said second instant, said control means:

execute a first control routine to check whether the excitation current has reached a peak value at a peak instant;

execute a second control routine to check whether a predefined period of time has passed from said peak instant;

execute a third control routine to check whether said excitation current is lower than a threshold value, said threshold value being calculated on the base of said peak value.

5. A switching device, according to claim 2, wherein said control means are arranged so that, after said movable plunger has reached said stop position, said control means send third control signals to said power supply means to supply one or more pulses of said excitation current.

6. A switching device, according to claim 1, wherein said second instant is an instant at which the following operating conditions are achieved:

the excitation current decreases after having reached a peak value at a peak instant;

a predefined period of time has passed from said peak instant;

said excitation current is lower than a threshold value ($I_{TH}$), said threshold value being calculated on the base of said peak value.

7. A switching device, according to claim 6, wherein said control means are arranged so that, in order to determine said second instant, said control means:

execute a first control routine to check whether the excitation current has reached a peak value at a peak instant;

execute a second control routine to check whether a predefined period of time has passed from said peak instant;

execute a third control routine to check whether said excitation current is lower than a threshold value, said threshold value being calculated on the base of said peak value.

8. A switching device, according to claim 6, wherein said control means are arranged so that, after said movable plunger has reached said stop position, said control means send third control signals to said power supply means to supply one or more pulses of said excitation current.

9. A switching device, according to claim 1, wherein said control means are arranged so that, in order to determine said second instant, said control means:

execute a first control routine to check whether the excitation current has reached a peak value at a peak instant;

execute a second control routine to check whether a predefined period of time has passed from said peak instant;

execute a third control routine to check whether said excitation current is lower than a threshold value, said threshold value being calculated on the base of said peak value.

10. A switching device, according to claim 9, wherein said control means are arranged so that, after said movable plunger has reached said stop position, said control means send third control signals to said power supply means to supply one or more pulses of said excitation current.

11. A switching device, according to claim 1, wherein said control means are arranged so that, after said movable plunger has reached said stop position, said control means send third control signals to said power supply means to supply one or more pulses of said excitation current.

12. A method for controlling the switching operations of a switching device, said switching device comprising:

at least a movable contact and a fixed contact that are adapted to be coupled or uncoupled during a switching operation of said switching device;

an electromagnetic actuator comprising an excitation coil, in which an excitation current circulates during a switching operation, and a movable plunger, which is operatively coupled to said movable contact through a kinematic chain, said movable plunger moving between a start position and a stop position during a switching operation;

power supply means that supply said excitation current to said excitation coil during a switching operation;

sensor means for generating sensing signals indicative of the intensity of the excitation current circulating in said excitation coil;

wherein the method comprises:

sending a first control signal to said power supply means to start with the supply of said excitation current from a first instant onwards;

commencing movement of the plunger from the start position toward the stop position when said excitation current reaches a peak value after the first instant;

determining, on the base of the information provided by said sensing signals, a second instant, at which said power supply means will stop the supply of said excitation current, said second instant occurring before said movable plunger has reached said stop position during the movement from said start position towards said stop position;

sending a second control signal to said power supply means to stop with the supply of said excitation current from said second instant and until said movable plunger reaches said stop position.

13. A method, according to claim 12, wherein said second instant is an instant at which said movable plunger has already reached a no return position during the movement from said start position towards said stop position.

14. A method, according to claim 13, wherein said second instant is an instant at which the following operating conditions are achieved:

the excitation current decreases after having reached a peak value at a peak instant;

a predefined period of time has passed from said peak instant;

said excitation current is lower than a threshold value, said threshold value being calculated on the base of said peak value.

15. A method, according to claim 13, wherein said step of determining said second instant-comprises the sub-steps of:

checking whether the excitation current has reached a peak value at a peak instant;

checking whether a predefined period of time has passed from said peak instant;

checking whether said excitation current is lower than a threshold value, said threshold value being calculated on the base of said peak value.

16. A method, according to claim 13, wherein said step of determining said second instant-comprises the sub-steps of:

checking whether the excitation current has reached a peak value at a peak instant;

checking whether a predefined period of time has passed from said peak instant;

checking whether said excitation current is lower than a threshold value, said threshold value being calculated on the base of said peak value.

17. A method, according to claim 13, wherein it comprises the step of sending third control signals to said power supply means to supply one or more pulses of said excitation current, after said movable plunger has reached said stop position.

18. A method, according to claim 12, wherein said second instant is an instant at which the following operating conditions are achieved:

the excitation current decreases after having reached a peak value at a peak instant;

a predefined period of time has passed from said peak instant;

said excitation current is lower than a threshold value, said threshold value being calculated on the base of said peak value.

19. A method, according to claim 12, wherein said step of determining said second instant comprises the sub-steps of:

checking whether the excitation current has reached a peak value at a peak instant;

checking whether a predefined period of time has passed from said peak instant;

checking whether said excitation current is lower than a threshold value, said threshold value being calculated on the base of said peak value.

20. A method, according to claim 12, wherein further comprising the step of sending third control signals to said power supply means to supply one or more pulses of said excitation current, after said movable plunger has reached said stop position.

* * * * *